United States Patent [19]

Roberts

[11] 3,937,435

[45] Feb. 10, 1976

[54] PAGE HOLDER AND BOOK SUPPORT

[76] Inventor: Raymond L. Roberts, 1521 Morningside Drive, Burbank, Calif. 91506

[22] Filed: Mar. 21, 1975

[21] Appl. No.: 560,706

[52] U.S. Cl. ..... 248/464; 248/465

[51] Int. Cl.[2] ..... A47B 97/04

[58] Field of Search ..... 248/441, 442, 446, 448, 248/449, 450, 454, 455, 456, 457, 463, 464, 465

[56] References Cited

UNITED STATES PATENTS

| | | | |
|---|---|---|---|
| 582,549 | 5/1897 | Schwab | 248/460 |
| 727,574 | 5/1903 | Berbecker | 248/463 |
| 766,982 | 8/1904 | Assel | 428/463 |
| 1,203,659 | 11/1916 | Smith | 248/456 |
| 2,787,086 | 4/1957 | Kraus | 248/463 X |

*Primary Examiner*—William H. Schultz
*Attorney, Agent, or Firm*—Roger A. Marrs

[57] ABSTRACT

A combined page holder and book support is disclosed herein having a shaped base formed with a pair of cut-outs along a selected end of the base and an elongated slot along the central longitudinal axis opening at the other end of the base. A pair of tab members are pivotally carried on the selected end of the base and rotate in and out of the respective cut-outs. A U-shaped support member is pivotally carried at the sides of the base and constitute a back for supporting an open book while the tab members constitute a pair separator. A brace is pivotally carried on the base and rotates into and out of the elongated slot. The brace detachably engages with the U-shaped member so as to support in an angular relationship to the base.

9 Claims, 6 Drawing Figures

PAGE HOLDER AND BOOK SUPPORT

BACKGROUND OF THE INVENTION

1. Field of the Invention

This invention relates to page holders and book supporting devices and, more particularly, to a novel page holder and book holder having means for forcibly separating the pages of a book as well as for supporting when the book is open.

2. Description of the Prior Art

In the past, page holding devices have been employed when a person reading a book desires to lay the book down with assurance that the open pages will not become turned over so that the reader loses his place. Such an event could readily happen when a person is reading while sitting out-of-doors where a breeze could easily blow over some of the pages of the book. Another occasion is present in the case of cook books. Both hands of the cook must be used for following the various cooking procedures while the selected page of the book must be maintained open. Also, unless a book has been opened and closed repeatedly through extensive use, the book binding generally is self-biasing so that the pages of the book will have a tendency to close or turn over when the book covers are separated. This situation occurs quite commonly when the books are new and the book binding relatively fresh and somewhat rigid.

Attempts have been made to provide a combined page holder and book support. However, conventional page holders tend to incorporate a plurality of parts such as springs, fasteners, levers and the like, which are not only bulky but which extend beyond the perimeter of the book so as to be cumbersome and awkward. Furthermore, many of the prior art devices include parts with rough edges or sharp corners that have a tendency to damage, cut or obscure the printing on the pages intended to be separated.

Another problem resides in storage of bulky book supporting and holding devices. In order to support a book, a substantial base and back support must be provided which is generally tall and wide which is a difficult construction to carry from place to place or to store in a relatively limited storage place.

Therefore, a need has long existed to provide a simple page holder and book support which is economical to manufacture and assemble and which will not damage either the pages of the book or deface or obscure the printing thereon and which is easy to carry about or to store.

SUMMARY OF THE INVENTION

The difficulties and problems encountered with conventional page holders and open book supports are obviated by the present invention which provides a shaped base having pivoted U-shaped support holding the back of an open book and a clip portion for retaining the wire on the book binding and a pair of pivoting tab members constituting a page separator for forcibly spreading the opposite and opposing page portions of the book.

In one form of the invention, the device has a first position which is upright and ready for use and a second position which is folded into a flat condition for storage or carrying purposes. The device includes a base having a yoke-like support pivoted thereon and a brace removably disposed to extend between the support and the base so as to place the support at an angle to the base. Tab means pivotally carried on the base serving as a page separator and a limit stop means is cooperatively carried to limit movement of the base and the support when rotated in the second or flat position.

Therefore, it is among the primary objects of the present invention to provide a novel page holder and book support device which is simple to manufacture, economical in cost and which is neither bulky nor cumbersome to assemble and operate.

Another object of the present invention is to provide a novel page separator and book support readily assembled and disassembled and adapted to provde tab means for bearing against the exposed leaves of an open book so as to operate effectively, regardless of how far reading of the book has progressed.

Still another object of the present invention is to provide a novel page separator and book support which folds upon itself for storage purposes and readily unfolds to provide both a support and a page separator which will not tear or damage either the pages, the print or the book binding.

A further object of the invention resides in providing a novel book holder and page separator combination that is foldable between an upright usable position and a folded, flat position for storage.

Another object resides in providing a novel book holder having built-in page separator means which may be constructed from a kit by relatively unskilled persons for educational and training purposes.

BRIEF DESCRIPTION OF THE DRAWINGS

The features of the present invention which are believed to be novel are set forth with particularity in the appended claims. The present invention, both as to its organization and manner of operation, together with further objects and advantages thereof, may be understood by reference to the following description, taken in connection with the accompanying drawings, in which:

DESCRIPTION OF THE PREFERRED EMBODIMENTS

Figure 1:
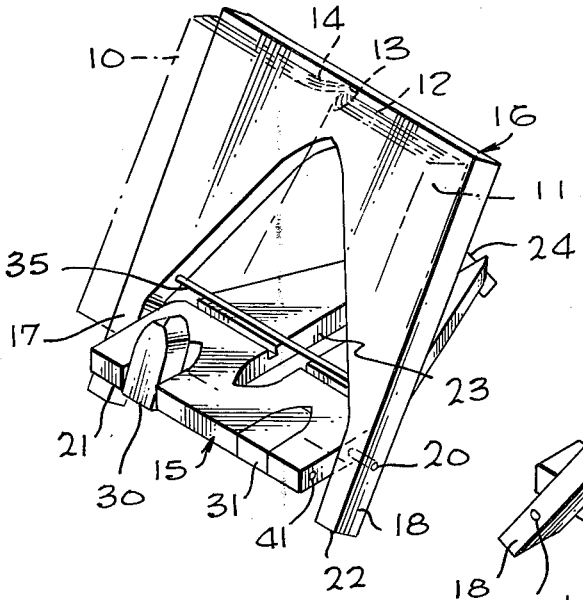
FIG. 1 is a front perspective view of the novel page holder and book support device of the present invention illustrated in a typical procedure for retaining pages of a book in an open position as well as supporting the book.

Referring to FIG. 1, the two sides or leaves of a book cover are indicated in broken lines by numerals 10 and 11, respectively, which are connected by any usual backing 12 and binding 13 in which the inner edges of pages 14 of the book are connected into securement therewith which may comprise sewing stitches of suitable cord in accordance with conventional practice.

The binding 13 may, of course, operate as the usual "back" for the book and, when the book is laying open, a space sometimes occurs between the back 12 and the binding 13 carrying the inner edges of the folios.

Figure 2:
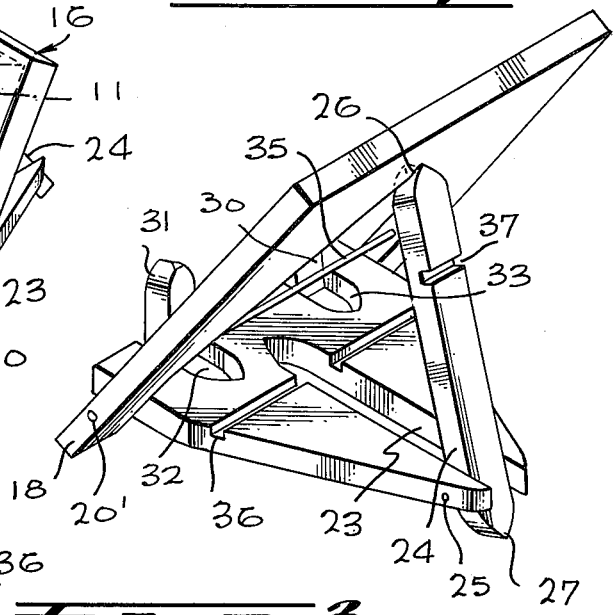
FIG. 2 is a rear perspective view of the device shown in FIG. 1.

The novel page separator and book holder of the present invention comprises a device having a base 15 which movably mounts a yoke-like book support member 16. Member 16 is U-shaped and includes legs 17 and 18 which straddle the base 15 and the respective legs are pivotally attached to the base by means of a pivot connection such as pivot 20. It is to be particularly noted that the legs 17 and 18 are pivoted on the side of base 15 and that the pivot connections 20 are located a short distance from the extreme end or edge marginal region of the base 15. This construction is important so that when the member 16 is pivoted to its upright position as shown in FIGS. 1 and 2, the extreme terminating ends of the legs 17 and 18 define a pair of feet indicated by numerals 21 and 22 respectively which serve to support the front end of the base 15. As shown more clearly in FIG. 2, the base includes an elongated slot 23 which may be occupied by a brace 24. The brace 24 is pivotally mounted on the base 15 by means of a pivot connection 25. One end of the brace 24 includes a notch 26 which detachably engages with the arched or top of the yoke member 16 so as to support the book support member 16 at an angle with respect to the base 15. The opposite end of brace 24 from its end formed with notch 26 provides a foot 27 that cooperates with the pair of feet 21 and 22 to serve as a triangular support for the base 15 as well as the entire device.

The page separator means of the present invention is provided by a pair of pivotal tab members 30 and 31 which are pivotally connected to the base 15 at the edge marginal region of the selected end of the base constituting the front of the device. When the tab members 30 and 31 are pivoted upwardly as shown in FIG. 2, a book may rest on the base 15 against the support member 16 and the pages of the respective books are held in place by engagement of the tab members 30 and 31 with the respective leads. It is to be noted that base 15 includes cavities 32 and 33 which are configured to correspond to the shape of the tab members 30 and 31 respectively. Therefore, it is important to note that when the tab members 30 and 31 are pivoted into the respective cavities and brace member 24 is pivoted into its receiving cavity 23, the device may assume a storage position or condition as that shown in FIG. 3.

Figure 3:
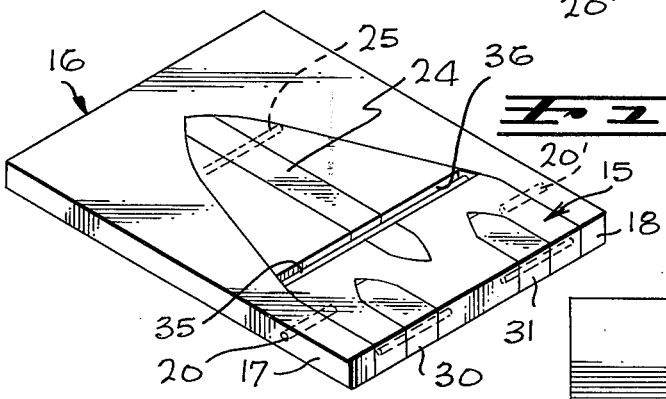
FIG. 3 is a front perspective view of the device illustrated in its flat or folded position for storage or carrying purposes.

In FIG. 3, the storage configuration for the device is illustrated which assumes a flat package for shipment, transportation or storge purposes. In addition to the tab members and brace being inserted into their respective cavities, it is noted that the base 15 has a peripheral shape or configuration which is identical to the cavity provided on the yoke member 16 so that the yoke member may be pivoted into a flat and coplanar relationship with respect to the remainder of the storage assembly. In FIG. 3, it can be seen that the device is fully folded and that a stop means is provided for limiting the pivotal relationship of support member 16 with respect to base 15. The limit stop means takes the form of a transverse rod 35 engaging with the bottom of a transverse slot 36 formed in the base 15. A co-extensive slot is similarly provided in brace 24 and is indicated by numeral 37 so that the rod 35 may extend across the base 15.

Figure 4:
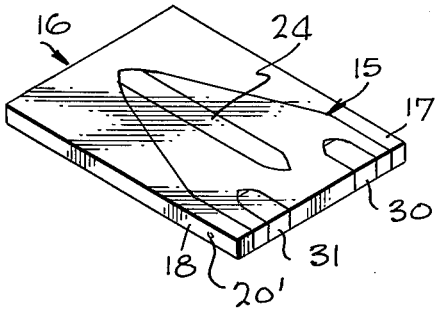
FIG. 4 is a reduced rear perspective view of the device in its flat or folded position.

Referring now to FIG. 4, the rear side of the device is illustrated where it can be noted that the slot 36 on the front side does not extend through the base. By this means, a stop is provided for rotating movement of the member 16 with respect to the base 15. It is also illustrated that both front and backsides of the device when in a folded or flat condition constitutes a top and bottom surface which are substantially co-planar with respect to each side of the device and that no projections, protrusions or other elements outwardly project from either the top or bottom sides.

Figure 5:
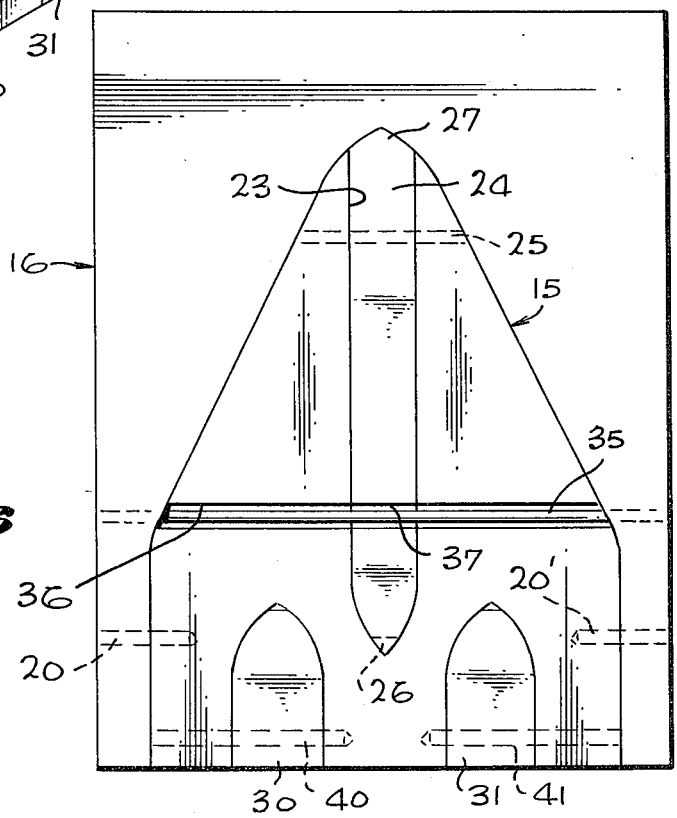
FIG. 5 is a top plan view of the device in its flat or folded position.
Figure 6:
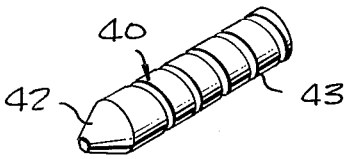
FIG. 6 is a perspective view of typical dowel pin employed as frictional pivot such as for rotatably mounting the page separator tabs.

Referring now to FIG. 5, a top plan view of the book holder and page separator of the present invention is illustrated and it can be seen that a plurality of pivot connections are provided for the respective parts and components. For example, brace 24 is pivoted on the base 15 by means of a dowel pivot 25. The legs 17 and 18 of the yoke support member 16 are pivotally secured to the sides of the base 15 by pivots 20 and 20′ while the tab members 30 and 31 are pivoted to the base 15 via dowel pivots 40 and 41 respectively. In FIG. 6, a typical dowel pivot is illustrated for rotably mounting the tab members 30 and 31. For example, pivot 40 is illustrated as having a tapered forward end 42 that is initially inserted through the base and then through the respective tab member back into the base. The other periphery of the dowel pin 40 includes a spiral groove 43 into which a suitable powder or glue is sometimes placed. However, in the present application the grooves remain open. Construction in this manner provides a tight fit so that rotation of the tab members is under yieldable friction and the tab members will stay in place when manually pivoted to a desired location.

Thus, it can be seen that the page holder and book support device of the present invention provides a means for adequately supporting the book and separating the pages while in use and at the same time provides a device which folds into a convenient flat construction for storage or carrying purposes. In the first position, as shown in FIGS. 1 and 2, the device is upstanding and the book support member 16 is rotated on its pivot 20 so that the notch 26 on brace 24 may be inserted against the edge of the cavity for support on the base 15. The book may be now opened to a selected page and the back of the book placed against the support member 16. Next, the tabs 30 and 31 are rotated out of their respective cavities so as to engage with the open pages of the book and the tab members will press against the pages so as to maintain the book in its open condition. The device as well as the book are supported on a supporting surface by means of a triangular base composed of the pair of feet 21 and 22 in combination with the brace foot 27. When it is desired to store the device, the book is removed from the device and the member 16 is rotated in a forward direction to disengage notch 26 with the rear edge and so that the brace 24 can be pivoted on pivot 25 to occupy the slot 23. Next, the support member 16 is rotated rearwardly until rod 35 engages with the bottom of the slots 36 and 37 to arrest further rotational movement of the support member. Next, the tab members 30 and 31 are rotated into their respective cavities and the device is now in condition for storage.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A book support and holder for supporting a book in its open condition to separate or divide the pages comprising the combination of:

a base having a predetermined configuration;

a U-shaped member having a cavity corresponding in shape to said base predetermined configuration and being pivotally carried adjacent a selected end of said base so as to rotate between a first position substantially angularly disposed with respect to said base and a second position substantially flat and coplanar with respect to said base;

a brace pivotally carried on said base for releasably engaging with said U-shaped member in said first position;

a pair of tab members pivotally carried along said selected base end and said base provided with a pair of cavities for receiving said tab members when said U-shaped member is in said second position; and said tab members and said U-shaped member cooperating to support and hold the book and papers open when said U-shaped member is in said first position.

2. The invention as defined in claim 1 wherein said brace is an elongated member having one pivoted on said base at its end opposite to said selected end and said base includes a slot having a shape to receive said brace when said U-shaped member is in said second position.

3. The invention as defined in claim 2 including stop means cooperating between said base and said U-shaped member for resting said base within said U-shaped member cavity in said second position.

4. The invention as defined in claim 3 wherein said stop means includes a transverse slot provided in said base extending across said base and a rod carried on said U-shaped member across said U-shaped member cavity and said rod cooperating with said slot to arrest movement of said U-shaped member with respect to said base.

5. The invention as defined in claim 4 wherein said pivotal tab members include dowel pins for pivot connection with said base and said dowel pins are formed with a spiral groove and provide a yieldably frictional fit.

6. The invention as defined in claim 5 wherein said U-shaped member includes a pair of feet and said brace includes a foot so as to provide a triangular support for said base when said U-shaped member is in said first position.

7. The invention as defined in claim 6 wherein said brace includes a notch provided in its free end for detachably engaging with said U-shaped member.

8. The invention as defined in claim 7 wherein said U-shaped member is in the form of an arch with legs on each side terminating in said pair of feet and pivot connections for rotatably securing said legs to said base at a distance away from said selected base end.

9. The invention as defined in claim 8 wherein said second position constitutes a flat condition having a substantially constant thickness for the book support and holder such as for storage and said first position constitutes an in-use condition with said base resting on said pair of feet and said brace foot.

* * * * *